US005422016A

United States Patent [19]

Herbertz

[11] Patent Number: 5,422,016

[45] Date of Patent: Jun. 6, 1995

[54] METHOD AND CENTRIFUGE FOR DEWATERING

[76] Inventor: Heinz Herbertz, Salierstrasse 19, 8600 Bamberg, Germany

[21] Appl. No.: 73,491

[22] Filed: Jun. 9, 1993

[30] Foreign Application Priority Data

Jun. 12, 1992 [DE] Germany ..... 42 19 536.5

[51] Int. Cl.[6] ..... F26B 11/04

[52] U.S. Cl. ..... 210/781; 210/739; 210/380.3; 210/143; 68/19; 68/23 R

[58] Field of Search ..... 34/8.58, 59, 312, 318, 34/319; 210/781, 787, 360.1, 380.2, 380.3, 739, 143, 148; 68/19, 23 R

[56] References Cited

U.S. PATENT DOCUMENTS 3,570,273 4/1911 Hertig ..... 210/380.2
3,945,921 3/1906 Toth ..... 210/376

FOREIGN PATENT DOCUMENTS 0096549 12/1983 European Pat. Off. .
2220470 10/1990 United Kingdom .

*Primary Examiner*—Robert A. Dawson
*Assistant Examiner*—David Reifsnyder
*Attorney, Agent, or Firm*—Wigman, Cohen, Lettner & Myers

[57] ABSTRACT

Dewatering by centrifuges in continuous laundry batch processing with short cycle time. A method is provided in which a number of batches are loaded into a centrifuge with a horizontal or titled axis and dewatered together. During the transport of the batches into the drum of the centrifuge, its speed is two to four times the distribution speed (the rotational speed at which the centrifugal force acting on the washing material at the inner diameter of the rings of wash is equal to the weight of the washed material). When the batch is in the drum, the speed is reduced to the distribution speed. After a uniform distribution of the wash the next step is an acceleration to four to six times the distribution speed. By this method the greatest portion of water is removed and a uniform ring of laundry is formed and space is created for more batches, which can be loaded thereafter according to the method described before, forming annular rings of laundry distributed about the inner surface of the centrifuge drum. All batches loaded in this way are dewatered at high extraction speed. In a continuous laundry batch processing with large output and extremely short cycle times, the batches are stored between washing and dewatering in controlled movable containers and automatically transferred to a number of centrifuges. A suitable centrifuge for the implementation of the new method has buffers, which are pressed against the swinging part of the centrifuge by a working cylinder during loading and acceleration of the drum and which are released beyond the critical speed.

4 Claims, 3 Drawing Sheets

METHOD AND CENTRIFUGE FOR DEWATERING

BACKGROUND OF THE INVENTION

The invention relates to a method for removing water from batches of wet material in batch washing systems and a centrifuge to carry out this method which loads and unloads automatically. Centrifuges need 5 to 10 minutes for loading, acceleration, spin drying, braking time and unloading. Therefore centrifuges are used as a part of washing installations in which batches of material pass through, like continuous laundry batch processing plants, only if cycle times are longer as 5 to 10 minutes. By this the output is limited. Washing installations with bigger output are furnished with dewatering presses which allow shorter cycle times by exert a pressure up to 30 atmospheres on the wet material. With centrifuges the same degree of moisture retention can be obtained with a pressure of 3 atmospheres. Thus wear and tear will be reduced and delicate material can be handled.

DESCRIPTION OF THE PRIOR ART

Such a centrifuge is known from the British Patent GB 2 220 470 in which one batch of wet material will be loaded at a time. During loading the centrifuge rotates with a number of revolutions favorable for the even distribution of the load before it accelerates to high speed. The housing of the centrifuge is elastically suspended and its axis extends mainly horizontal. By means of working cylinders the opening of the housing can be tilted upwardly for loading and downwardly for unloading. Furthermore, a centrifuge of the related art is known by the European Patent Application 0 096 549. This centrifuge has a vertical axis and a number of compartments, situated around this axis, to receive batches of wet material and dewater it altogether.

For reasons already explained the known centrifuge with a mainly horizontal axis is not suitable for washing installations with bigger output. The known centrifuge with a vertical axis requires extremely complicated devices for automatically loading and unloading.

The known centrifuge with the vertical axis requires a certain number of batches of equal weight, because there is no possibility to balance out differences.

SUMMARY OF THE INVENTION

It is the object of the invention to improve the method and the centrifuge for dewatering known. This object is accomplished by the invention in that loading the batches one after another into the rotating drum of a centrifuge with a horizontal or inclined axis and in that before the next batch enters the centrifuge, the rotating speed will be increased to a low dewatering speed and thereafter reduced to a speed suitable for loading of the next batch.

In an advantageous further development of the invention, specially for batch washing systems of large capacity, the batches of wet material will be stored before spin drying in automatically controlled, movable containers suitable for loading and distribution to several centrifuges.

The advantages given by the invention consist mainly in the multiplication of the capacity of the centrifuge by loading a number of batches instead of one batch. This will be achieved by compressing each batch after loading by acceleration of the rotating speed after loading, whereby large amounts of water will be removed at a low dewatering speed and so space has been created for loading the next batch. Furthermore, disturbances by out of balance loads will be avoided, because the second and the following batches fill gaps in the rings of wash of batches loaded before.

The method according to the invention and the employment of two or more centrifuges and the storage of batches in movable containers makes it possible to use centrifuges in large installations with extreme short cycle times. During the storage in suitable containers water will be removed from the batches by gravity. Through that the time for the following steps of the procedure will be reduced.

The method according to the invention can be carried out with all kinds of centrifuges with horizontal or declined axles in which the laundry is distributed by rotation of the drum. The speed control necessary can be built into such centrifuges, subsequently.

A centrifuge with special qualities for the method according to the invention has buffers of elastical material, pressed to the swinging part of the centrifuge by working cylinders during the critical speed.

By that the oscillation is limited during the critical speed, which had to be passed several times while carrying out the method according to the invention.

With the foregoing and other objects, advantages and features of the invention that will become hereinafter apparent, the nature of the invention may be more clearly understood by reference to the following detailed description of the invention, the appended claims and to the several views illustrated in the drawings.

DESCRIPTION OFT HE PREFERRED EMBODIMENT

Figure 1:
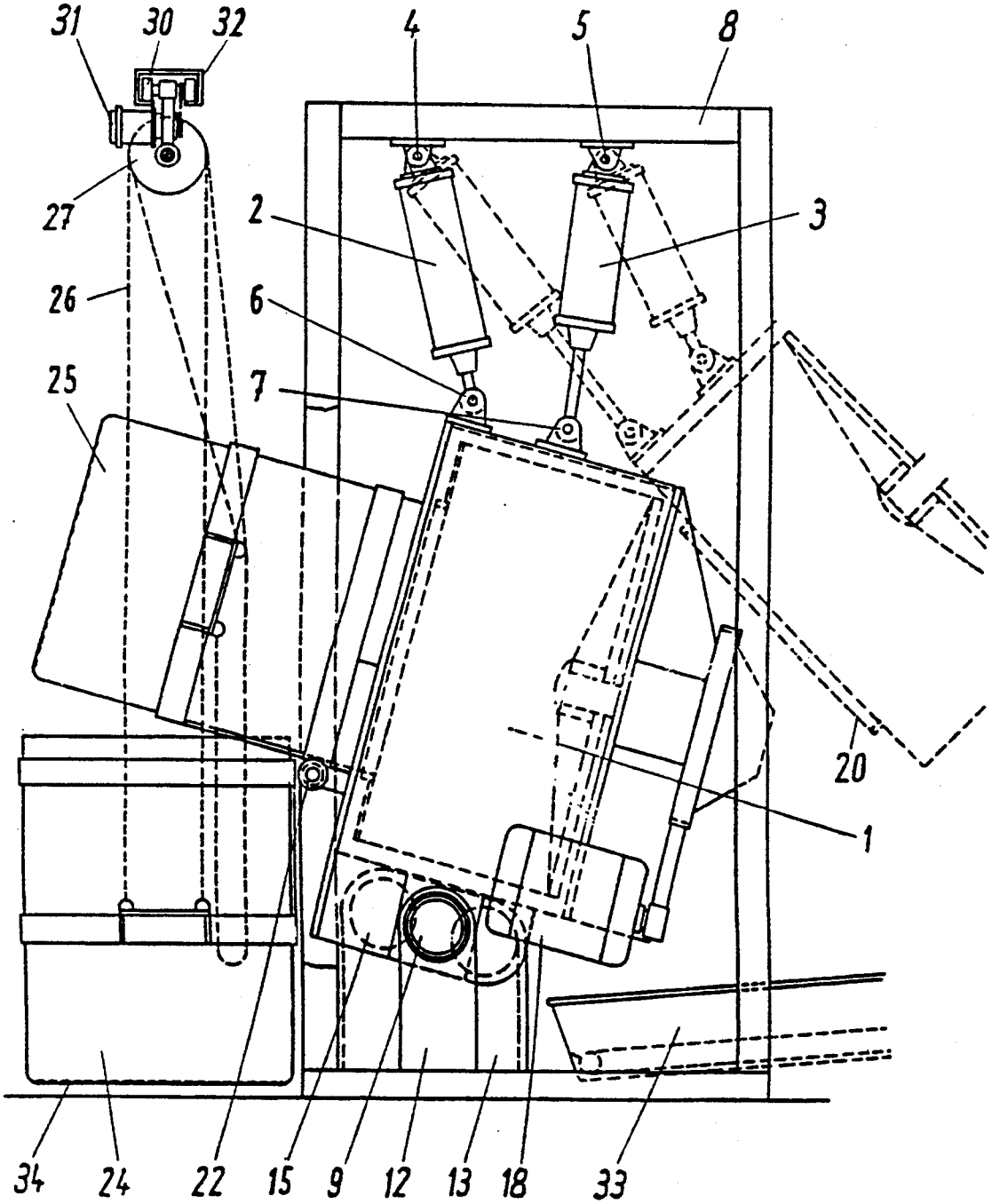
FIG. 1 is a side view of the centrifuge in loading position and the movable containers in continuous lines and parts of the centrifuge in unloading position are indicated in broken-off manner and in dashed lines.
Figure 2:
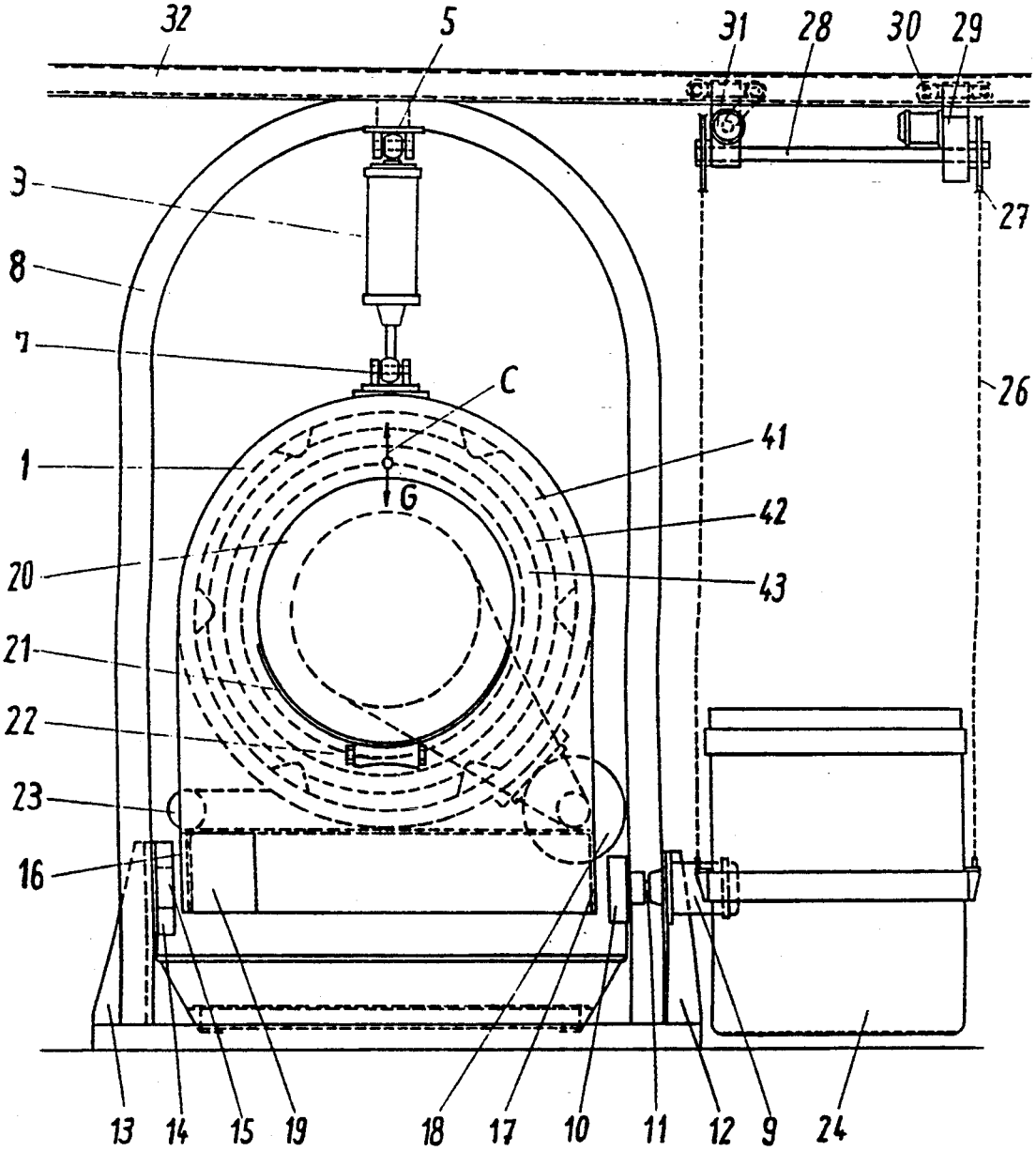
FIG. 2 is a front view of the centrifuge in centrifuging position with the travelling crane for the movable containers.

The centrifuge 1 is suspended to a carrier 8 by means of pneumatic cylinders 2 and 3, which have universal joints 4, 5, 6 and 7 on both ends, as shown in FIG. 1. Another pneumatic cylinder 9 carries a buffer 10 made of elastic material on its piston rod 11. The cylinder 9 is fixed to a pillar 12, which belongs to the non-moving parts of the centrifuge. On the opposite side, buffers 14 and 15 are fixed to a pillar 13. As shown in FIG. 2, the suspended part of the centrifuge has reinforced sides 16 and 17 in the area of the buffers 10, 14 and 15. The motor 18 is mounted to one side of the centrifuge and at the opposite side is a counter-weight 19 fastened. There is a centric opening 20 for loading and unloading and a guide 21 to hold the movable containers in a correct position during loading the centrifuge. A roller 22, fitted to the diameter of the containers, is mounted in front of it. The movable containers 24 and 25 have perforated bottoms. The water will be removed from the centrifuge by means of a pipe 23.

The movable containers 24 and 25 are suspended to chains 26 and 27 and moved by sprocked-wheels 27 which are attached to a gear unit 29 by an axle 28. A travelling crane 30 moves on rails 32 driven by a gear unit 31. Under the centrifuge is a belt conveyor 33 for the transport of the dewatered laundry.

The mode of operation: The batch washing units unload the laundry by means of a chute (both not illustrated) into the movable containers 24, 25. (One or two containers per centrifuge.) The movable container 25 is suspended to the travelling crane 30 by means of the chains 26 and will be moved in front of the opening 20 of the centrifuge 1 by means of the gear unit 31. After that the sprocket wheels 27 turn clockwise and tilt the movable container 25, supported by the roller 22, and its open top meets the opening 20 of the rotating centrifuge 1, while the guide 21 holds it centrical. After that, the sprocket wheels 27 turn anti-clockwise till the movable container 25 has a vertical position and will be moved by the travelling crane 30 to a parking position so that the following container can be moved in front of the opening of the centrifuge.

During the entire procedure of loading and the critical speed, the pneumatic cylinder 9 presses the buffer 10 against the reinforced side 17 of the centrifuge 1. Through that, the reinforced side 18 at the opposite side of the centrifuge will be pressed against the buffers 14 and 15. For high speed extraction, the buffer 10 moves back, the pneumatic cylinders 4 and 5 will go to middle position, balancing the centrifuge in a horizontal position. As known by related arts, the suspended system can oscillate freely in all 6 directions, far beyond the critical speed of the centrifuge. After high speed extraction the centrifuge will slow down to a very low speed, the opening 20 tilts downward through actuation of the pneumatic cylinder 4 and the laundry will be unloaded to the belt conveyor 33.

Figure 3:
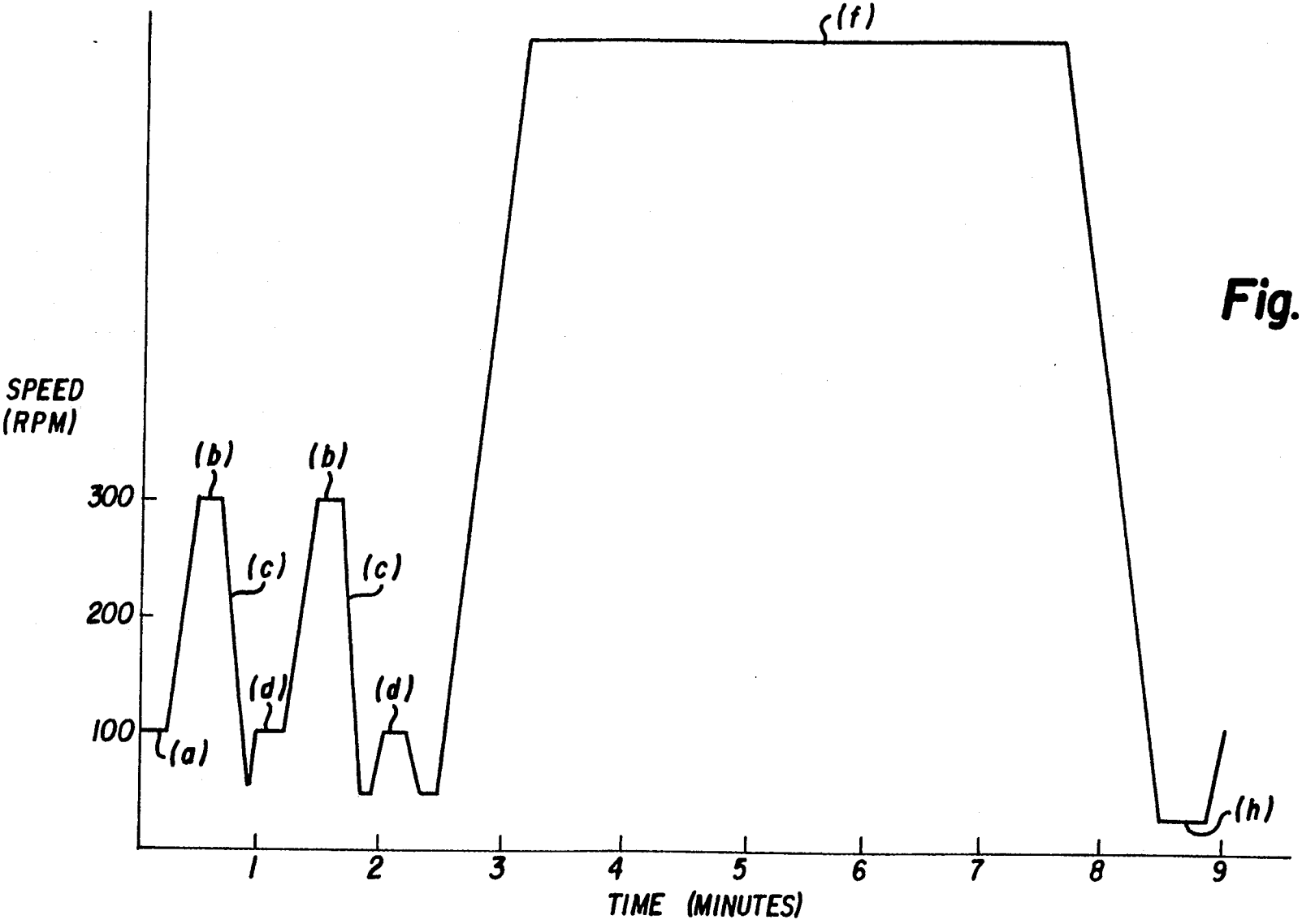
FIG. 3 is a graphical representation of a method of dewatering a plurality of batches in a batch washing system.

More particularly, and with reference to FIG. 3, a first batch of laundry is loaded into the centrifuge 1 which is running at a first loading speed (a). The centrifuge 1 is then accelerated to a low dewatering speed (b) to partially dewater that first batch, followed by deceleration (c) to a second loading speed (d). The second loading speed (d) may be equal to or an adjustment of the first loading speed (a) to accomodate the increased inertial load of the laundry now contained within the centrifuge 1. For example, the first loading speed (a) is at about 100 r.p.m. and the subsequent loading and distribution speed (d) occurs at about 48 r.p.m. In like manner, additional batches are loaded into the centrifuge andspartially dewatered until all of the batches to be dewatered have been loaded. The centrifuge 1 is then accelerated to a high dewatering speed (f) for a time necessary to substantially dewater all of the batches contained therein, followed by deceleration to speed (h) of about 25 r.p.m. or lower at which speed all of the batches are unloaded together from the centrifuge 1.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A method for dewatering a plurality of batches in a batch washing system, comprising the steps of:

(a) loading one of the plurality of batches into a centrifuge having a rotational axis;

(b) accelerating the centrifuge to a low dewatering speed and extracting a quantity of water from said batch thereby forming said batch into an annular layer;

(c) decelerating the centrifuge to a speed suitable to load the next batch;

(d) loading the next batch into the centrifuge;

(e) repeating steps (b)–(d) until the plurality of batches is loaded;

(f) accelerating the centrifuge to a high dewatering speed and extracting water until all of said batches have been substantially dewatered and formed into concentric annular layers;

(g) decelerating the centrifuge to an unloading speed; and (h) unloading together all of said batches.

2. The method of claim 1, comprising the additional step of:

distributing all of said unloaded batches into separately assigned movable containers.

3. The method of claim 1, wherein said high dewatering speed is in the range of about two times to about four times the low dewatering speed.

4. The method of claim 1, comprising the additional step of:

tilting the centrifuge to an inclined angle during the unloading step to position a centrifuge loading and unloading opening below a horizontal plane coincidental with the rotational axis of said centrifuge.

* * * * *

UNITED STATES PATENT AND TRADEMARK OFFICE

CERTIFICATE OF CORRECTION

PATENT NO. : 5,422,016
DATED : June 6, 1995
INVENTOR(S) : Herbertz

It is certified that error appears in the above-indentified patent and that said Letters Patent is hereby corrected as shown below:

Title page, item [54] and col. 2, line 1-2, in the Title should read--DEWATERING METHOD FOR BATCH WASHING SYSTEMS--.

Column 2, line 45, "DESCRIPTION OFT HE PREFERRED EMBODIMENT" should read--DESCRIPTION OF THE PREFERRED EMBODIMENT--.

Signed and Sealed this

Twenty-first Day of November, 1995

Bruce Lehman

*Attest:*

BRUCE LEHMAN

*Attesting Officer*

*Commissioner of Patents and Trademarks*